US005849154A

United States Patent [19]

Takano et al.

[11] Patent Number: 5,849,154

[45] Date of Patent: Dec. 15, 1998

[54] PRINTING PAPER COATED WITH LOW-MOLECULAR ANIONIC ACRYLAMIDE AND METHOD OF PRODUCING SAME

[75] Inventors: Toshiyuki Takano; Motoi Fukuda; Toshimi Satake, all of Tokyo, Japan

[73] Assignee: Nippon Paper Industries Co., Ltd., Tokyo, Japan

[21] Appl. No.: 774,790

[22] Filed: Dec. 30, 1996

[51] Int. Cl.[6] ..... D21H 19/10

[52] U.S. Cl. ..... 162/135; 162/168.3; 427/391; 428/219; 428/479.6

[58] Field of Search ..... 162/135, 168.3; 427/391; 428/219, 479.6

[56] References Cited

U.S. PATENT DOCUMENTS 2,945,775 7/1960 Lehman et al. ..... 162/135

OTHER PUBLICATIONS

Casey, *Pulp and Paper*, 3rd ed (1981) vol. III pp. 1679 & 1680.

*Primary Examiner*—Peter Chin
*Attorney, Agent, or Firm*—Knobbe, Martens, Olson & Bear, LLP

[57] ABSTRACT

A printing paper, especially a newsprint base paper, comprising a base paper, suitably lightweight acid base paper, and a coating layer for improving surface strength of the coated paper and releasing-property when two sheets of the coated paper are stacked, which coating layer is formed on the base paper by using a coating-transcription system such as a gate-roll coating system, which coating layer comprises low-molecular anionic polyacrylamide in a coating weight of from 0.01 g/m$^2$ to 0.2 g/m$^2$, wherein the anionic polyacrylamide have a weight average molecular weight ranging from 10,000 to 150,000, thereby improving not only surface strength but also releasing-property in a printing paper, especially in a newsprint paper having a basis weight less than 46 g/m$^2$.

18 Claims, No Drawings

PRINTING PAPER COATED WITH LOW-MOLECULAR ANIONIC ACRYLAMIDE AND METHOD OF PRODUCING SAME

BACKGROUND

1. Field of the Invention

The present invention relates to printing paper having a coating layer, particularly to newsprint paper having a coating layer, which exhibits improved surface strength and suppressed adhesiveness, and to the manufacturing method thereof. The present invention is suitably applied to light-weight acid base paper.

2. Background of the Art

In general, newsprint paper (paper for printing newspaper, a roll of newsprint) is mainly composed of mechanical pulp and de-inked pulp (hereinafter "de-inked pulp" is referred to as "DIP") and classified into medium-grade paper or low-grade paper. Newsprint paper is, however, required to satisfy quality requirements stricter than those for general printing paper, since a specified number of newspapers must be printed in a specified duration of time in a specified time zone with certainty in newspaper printing. Newsprint paper is special paper from such a viewpoint, thus a special classification is applied to it. In addition, since a reduction in weight, an increase in content of DIP, etc. are further required for newsprint paper, improvement to satisfy all these needs is required. Thus, improvement of newsprint paper requires a much higher level of technology as compared with that of general printing paper.

Recently, in the field of printing technology for newspapers, transition from relief printing to off-set printing has rapidly proceeded together with the introduction of computer systems into printing of newspapers, in order to respond to the necessity of an increase in printing speed, coloring of the paper, various kinds of printing, and automation, for example.

Newsprint paper used for off-set printing is required to have different qualities from those used for relief printing. These quality requirements include that (1) paper should have wet strength and not suffer from water break; (2) paper should retain adequate water absorptivity; and (3) paper should have surface strength. Among these quality requirements, improvement on surface strength, which involves resolving paper powder problems, is a particularly critical target. Under such circumstances, similar properties are desirable for general printing paper.

In printing paper, especially in newsprint paper, recent trends other than an increase in surface strength, a reduction in weight and an increase in content of DIP, etc. are also sought.

As for a reduction in weight of newsprint paper, for example, in Japan, paper with a basis weight of 46 g/m$^2$ accounted for 96% of newsprint paper in 1989, but paper with a basis weight of 43 g/m$^2$ has come to account for as high as approximately 80% in 1993. With progress towards a reduction in the weight of paper, problems such as a decrease in opaqueness of newsprint paper and a reduction in paper strength, etc. have arisen, and increases in amounts of fillers and pigments are required to cope with these problems. However, the increases in amounts of these components together with a tendency of newsprint paper itself towards being thinner and lighter cause the phenomenon that the added components are easily released from the surface of paper. In particular, when off-set printing that requires paper moistening be used, the fiber network of the paper becomes loosened upon moistening, resulting in an increase in the release if fillers and pigments. This problem becomes more serious as reduction in paper weight is progressed. For example, improvement of paper with a basis weight lower than 46 g/m$^2$ is a more difficult problem to be solved than that of paper with a basis weight of 46 g/m$^2$ or higher.

At the same time, an increase in DIP content caused increases in amounts of components such as microfiber fillers, and pigments derived from DIP, which in turn cause problems such as dropping of paper powder and a decrease in paper strength. These problems also become more serious as the composition ratio of DIP increases.

In any event, recent trends in newsprint paper work as serious disadvantageous factors, especially wit respect to surface strength.

There are roughly two means known to improve the surface strength of newsprint paper, those not using coating operation and those using coating operation.

The means not using coating operation comprises alteration of raw material composition, alteration of paper manufacturing conditions, and an increase in amounts of paper strength-reinforcing agents. However, it is difficult to comply with strict quality requirements for newsprint paper used for off-set printing by only relying on such means.

On the other hand, the coating means are effective in improving surface strength, because it is a method of coating-surface treatment agents such as starch, modified starch (oxidized starch, starch derivatives, etc.), and polyvinyl alcohol (abbreviated as "PVA" hereinafter) on the surface of newsprint paper (external addition). Application of external addition of agents is also considered for general printing paper.

For economic reasons, on-machine coating has been generally employed for coating surface-treatment agents onto the surface of newsprint paper. In particular, a gate-roll coater using a coating formation and transcription system, which enables high-speed coating, has commonly been used. Characteristics of the gate-roller coating method are simply summarized in, for example, Japan TAPPI Journal 43 (4), p. 36, 1989 and Paper Pulp Technology Times Vol. 36, No. 12, p. 20, 1993. This method enables coating liquid to be retained on the surface of paper and is thus more effective for improvement of paper surface, as compared with a conventional two-roll size press method. In the two-roll size press method, since base paper passes through a pond (liquid pool) of coating liquid, the base paper is impregnated very deeply with the coating liquid. In contrast, in the gate-roll coating method, since coating liquid forms a film in advance, which is then transcribed to the surface of base paper, the base paper is not substantially impregnated with the coating liquid. Thus, in the gate-roll coating method, coating material tends to remain on the surface of base paper and efficient improvement of paper surface can be achieved.

However, as described above, recent trends in newsprint paper, i.e., reduction in paper weight and an increase in content of DIP, are highly negative factors with respect to surface strength, and therefore, the coating weight of surface-treatment agents need to be increased. When surface-treatment agents such as starch groups and PVA are used in high amounts, problems due to their adhesiveness (which is called "Neppari") are caused in manufacturing or printing of newsprint paper, since the agents exhibit adhesiveness when moistened with water. This adhesion problem is more pronounced and serious when the gate-roll coating method is employed for coating than when the two-roll size press method is employed.

Thus, properties of not only improving surface strength but also reducing adhesiveness of coated paper, i.e., good releasing-property of coated paper, are required essentially for surface-treatment agents used for newsprint paper.

As described above, a single coating of starch, modified starch, or PVA is in fact effective in improving surface strength to a certain extent when the coating weight is increased. When the coating weight is increased, adhesiveness of the coated paper increases and releasing-property suffers.

Adhesion-preventing agents, which are added to surface-treatment agents and improve releasing-property, are disclosed in Japanese Patent Application Laid-open No. 6-57688 (1994) and No. 6-192995 (1994), for example. That is, adhesion-preventing agents comprising organic fluoro compounds are disclosed in Japanese Patent Application Laid-open No. 6-57688, and adhesion-preventing agents containing substituted succinic acid and/or substituted succinic acid derivatives as effective components disclosed in Japanese Patent Application Laid-open No. 6-192995. These adhesion-preventing agents improve releasing-property and are useful agents in increasing the coating weight of surface-treatment agents. However, the use of these adhesion-preventing agents cause drawbacks such as (1) bubbling of coating material is noticeable when applied on the surface, most likely because a coating material is composed of two component bases, surface-treatment agents and adhesion-preventing agents; and (2) the cost tends to go up.

Sizing agents for paper are disclosed in the Japanese Patent Application Laid-open Nos. 5-59689, 5-295693, and 7-238492, for example. Particularly in Japanese Patent Application Laid-open No. 7-119078, disclosed is a composition composed of PVA and block copolymer of ethylenoxide and propyleneoxide, which is applied on newsprint paper, resulting in that the newsprint paper has low adhesiveness during off-set printing and has an improved surface strength. The composition allows for improvement of releasing-property to a certain degree, as compared with a single use of starch-based material or PVA. However, when reduction in weight and an increase in content of DIP progress further, it is impossible to exhibit satisfactory surface strength and releasing-property.

Many surface-treatment agents using PAM (polyacrylamide) are suggested in, for example, Japanese Patent Publication No. 40-24926 (1965), Japanese Patent Laid-open No. 59-163498 (1984), 3-199489 (1991), 5-163697 (1993), 6-65893 (1994), 6-65894 (1994), 6-157679 (1994), and 6-179728 (1994). In Japanese Patent Publication No. 40-24926, disclosed is a reaction product composed of PAM (or anionic PAM) and polyhydric aldehyde. In Japanese Patent Laid-open NO. 59-163498, disclosed is a composition composed of anionic PAM having an average molecular weight ranging from 10,000 to 500,000 and PAM modified by the Mannish reaction having an average molecular weight ranging from 10,000 to 500,000. In Japanese Patent Laid-open No. 3-199489, disclosed is a vessel pick-preventing agent composed of a low-molecular polymer of acrylamide having an average molecular weight of 100,000 or lower and a high-molecular polymer of acrylamide having an average molecular weight of 400,000 or higher. In Japanese Patent Laid-open No. 5-163697, disclosed is a surface-treatment agent composed of a (meth) acrylamide copolymer having an average molecular weight ranging from 50,000 to 1,000,000 and a (meth)acrylamide copolymer having an average molecular weight ranging from 2,000,000 to 20,000,000. In Japanese Patent Laid-open Nos. 6-65893, 6-65894, 6-157679, and 6-179728, disclosed are PAM copolymers composed of three to five types of monomers. Particularly in Japanese Patent Laid-open Nos. 6-157679 and 6-179728, it is taught that PAM copolymers having a molecular weight ranging from 800,000 to 2,500,000 are preferred.

However, releasing-property of coated paper, which is highly required for gate-roll coating methods, is not considered in surface-treatment agents using the above PAMs. Therefore, even if the surface-treatment agents are applied to newsprint base paper having a basis weight of 46 g/m$^2$ or less, releasing-property of coated paper ("neppari") is not sufficient, although surface strength is improved.

In Japanese Patent Laid-open No. 60-59193, disclosed is a surface-protecting layer-forming agent composed of a copolymer (anionic PAM) of (meth)acrylamide ("(meth) acrylamide" denotes "acrylamide and/or methacrylamide" hereinafter), acrylic acid or its derivatives, and vinyl monomer, to which copolymer a crosslinking agent is added. However, this surface-protecting layer-forming agent is applied onto a coating layer of thermal-sensitive recording paper, i.e., it is not designed for improving the surface of paper itself.

Further, in Japanese Patent Laid-open No. 1-186372 (1989), disclosed is an ink-jet-recording paper containing polyacrylamides having an average molecular weight ranging from 10,000 to 500,000. However, as with the above, this technology is not for improving surface strength of paper, and PAM functions as a binder for fixing synthetic amorphus sillic that forms an ink-receiving layer.

In addition, as an example of PAM used in newsprint paper, Japanese Patent Laid-open No. 55-36315 (1979) discloses newsprint paper in which amphoteric PAM (Mannich reaction products of anionic PAM) is used as an internal additive.

However, in the reference, the amphoteric PAM is used as an internal additive for the sake of paper strength, and is essentially different from material aimed at improving paper strength in gate-roll coating methods. Further, even if this amphoteric PAM is added externally, releasing-property of coated paper ("neppari") remains problematic.

Under the above circumstances, what has been sought is surface-treatment agents which improve not only surface strength but also mitigate adhesiveness, i.e., improve releasing-property, in paper, especially lightweight newsprint paper having a basis weight less than 46 g/m$^2$.

SUMMARY OF THE INVENTION

The present invention has exploited a printing paper, especially a lightweight newsprint paper, having improved not only surface strength but also releasing-property. An objective of the present invention is to supply surface-treatment agents suitable for base paper, especially lightweight newsprint base paper having a basis weight less than 46 g/m$^2$, and another objective of the present invention is to supply paper such as lightweight acid newsprint paper, especially newsprint paper suitable for off-set printing, on which surface-treatment agents are applied, which paper has good and well balanced surface strength and releasing-property.

The above objectives are achieved by the present invention. Namely, an important aspect of the present invention is a printing paper, especially a newsprint base paper, comprising: (1) a base paper such as lightweight acid base paper; and (2) a coating layer formed on said base paper by using a coating-transcription system such as a gate-roll coating system, for improving surface strength of the coated paper and releasing-property when two sheets of the coated paper are stacked, said coating layer comprising an anionic polyacrylamide in an effective amount, preferably in the range of from 0.01 g/m$^2$ to 0.2 g/m$^2$ per one side of said base paper, said anionic polyacrylamide having a weight average molecular weight ranging from 10,000 to 150,000, preferably ranging from 30,000 to 80,000. Preferably, the anionic polyacrylamide is partially-hydrolyzed polyacrylamide or a copolymer of an acrylamide-base monomer and an acrylic acid-base monomer. The anionic polyacrylamide can interact with aluminum sulfate which is usually contained in acid paper. Due to low-molecular weights and the anionic character of the anionic polyacrylamide as well as a coating-transcription system, not only surface strength but also releasing-property of a printing paper, especially an acid paper having a basis weight less than 46 g/m$^2$, are significantly improved. That is, the effects are prominent when the present invention is applied to a lightweight acid printing paper.

Another important aspect of the present invention is a method for producing a printing paper, comprising: applying to one side or both sides of a base paper by using a coating-transcription system, a coating solution comprising an anionic polyacrylamide to form a coating layer on said base paper for improving surface strength of the coated paper and releasing-property when two sheets of the coated paper are stacked, said anionic polyacrylamide having a weight average molecular weight ranging from 10,000 to 150,000. In the above, preferable aspects can be the same as in the aforesaid printing paper itself. In the present invention, "polyacrylamide" is abbreviated as "PAM" hereinafter.

As described above, in the present invention, paper having excellent surface strength and releasing-property, which are well balanced with each other, can be obtained by applying to base paper, especially to newsprint base paper, anionic PAM having a low molecular weight in a particular range, especially at a coating weight ranging from 0.01 g/m$^2$ to 0.2 g/m$^2$, by using a gate-roll coater.

Since the anionic PAM used in a surface-treatment agent in the present invention have low molecular weights, their viscosities are relatively low. Thus, handling is easy, and it is possible to increase their concentration in a coating solution, leading to reduction in transportation costs and satisfaction of economic interests.

The low-molecular anionic PAM used in the present invention can satisfy both surface strength and releasing-property when simply used as a sole component in a surface-treatment agent. In the above, as compared with conventional two-component-based surface-treatment agents, other advantages such as 1) low cost, and 2) little bubbling during coating operation can also be exhibited.

In addition, it is possible to obtain a universal surface-treatment agent for a gate-roll coater by using the low-molecular anionic PAM of the present invention as a useful base polymer or polymers in gate-roll coating material in combination with sizing-property-providing material, strength-improving material, and the like.

The paper, especially newsprint paper, of the present invention resolves problems caused by adhesiveness and insufficient surface strength at off-set printing, and thus, the paper is very suitable for off-set printing.

In Japanese Patent Laid-open No. 4-329177 (1992), disclosed is paper for continuous recording characterized in that anionic PAM (the molecular weight range of 3,000–100,000) is applied to the surface of pH-neutral paper. However, this reference does not lead to the base paper, especially newsprint base paper, coated by a gate-roll coater of the present invention, because 1) the examples disclosed in the reference relate only to size press operation, and 2) no ionic interaction between aluminum sulfate and anionic PAM can be expected.

Further, regarding the relationship between the molecular weight of PAM when used as an external additive and its effects when applied on the surface of paper, it has been empirically recognized in the art that PAM having a sufficient molecular weight is required for improving surface strength since "the higher the molecular weight of PAM, the greater the effect of improving surface strength becomes."

For example, regarding coating agents for a gate-roll coater, Harima Technical News No. 43, p 17 (1995) reported that, by increasing the molecular weight of a PAM-base coating material four to five times that of conventional material (a molecular weight of 400,000–500,000), 1) efficiency of strengthening polymer is improved, and 2) penetration into paper is decreased.

In contrast, the present inventors found that, in gate-roll coating methods applied to newsprint paper having a basis weight less than 46 g/m$^2$, when low-molecular anionic PAM having a molecular weight range lower than that of conventionally used PAMs is used, it is possible to sufficiently improve surface strength, and that adhesiveness of paper coated by a gate-roll coater is low. Accordingly, the present invention has been completed.

DETAILED DESCRIPTION OF THE PREFERRED EMBODIMENTS

Polyacrylamides in General

PAM is a typical synthetic aqueous polymer, and briefly described in "Kami to Kakou no Yakuhin Jiten (Chemicals Dictionary for Paper and Process)" (p. 241, Tech Times 1991). In the paper manufacturing industry, PAM is widely used as yield-improving agents, filtration-improving agents, dried paper strength-reinforcing agents, and so forth.

However, unmodified PAM itself (a copolymer of polyacrylamide and acrylamide) has not been used in the paper manufacturing industry, since unmodified PAM is only slightly ionic. Anionic PAM and amphoteric PAM (or cationic PAM) have therefore been used. Anionic PAM includes, for example, PAM whose amide group is partially hydrolyzed and a copolymer of PAM monomer and (meth) acrylic acid ("(meth)acrylic acid" denotes "acrylic acid and/or methacrylic acid" hereinafter). As yield-improving agents or freeness-improving agents, high molecular weight anionic PAM (the molecular weight is approximately 800,000–1,000,000, for example) is used. As dried paper strength-reinforcing agents, relatively low molecular weight anionic PAM (the molecular weight is approximately 500,000–700,000, for example) is used. Amphoteric PAM (or cationic PAM) includes, for example, PAM modified by the Mannich reaction, PAM degraded by the Hoffman degradation reaction, and a copolymer of PAM monomer and cationic monomer (dimethylaminoethyl(meth)acrylate, diacryldimethylammoniumchloride, or the like).

Molecular Weight of PAM

As described above, regarding the relationship between the molecular weight of PAM when used as an external additive and the effects when applied on the surface of paper, it has been empirically recognized in the art that the higher the molecular weight of PAM, the greater the effect in improving surface strength becomes. For example, the aforesaid Harima Technical News reported that a molecular weight of 400,000–500,000 was effective.

In contrast, in the present invention, in gate-roll coating methods applied to newsprint paper having a basis weight less than 46 g/m$^2$, when low-molecular anionic PAM having a molecular weight range lower than that of conventionally used PAMs is used, it is possible to sufficiently improve surface strength, and that adhesiveness of paper coated by a gate-roll coater is low.

That is, the present invention relates to paper, especially lightweight base paper such as newsprint base paper having a basis weight less than 46 g/m$^2$, having a gate-roll coating layer comprising a low-molecular anionic PAM having a weight average molecular weight ranging from 10,000 to 150,000.

Surface-treatment agents usable in the present invention are a low-molecular anionic PAM having a weight average molecular weight ranging from 10,000 to 150,000. One PAM alone or a mixture of two or more PAMs can be employed. When the weight average molecular weight of PAM used in the present invention is more than 250,000, releasing-property suffers, i.e., neppari strength (adhesion strength) is high, resulting in that neppari problems tend to easily occur. On the other hand, when the weight average molecular weight of PAM used in the present invention is less than 20,000, the effects in improving surface strength are not satisfactory when in the amount of a coating described later. With regard to releasing-property, the lower the molecular weight of PAM, the better the releasing-property becomes, and when the weight average molecular weight is 50,000 or less, adhesiveness is negligible in neppari tests described later. On the other hand, for improving surface strength, as described above, the higher the molecular weight of PAM, the higher the effect becomes, i.e., the relationship is opposite to the relationship between the releasing-property and the molecular weight. Thus, in the present invention, the weight average molecular weight ranging from 30,000 to 80,000 is further preferred in view of not only releasing-property but also surface strength.

Anionic Character of PAM

A low-molecular anionic PAM used as a surface-treatment agent in the present invention includes PAMs obtained by partial hydrolysis of acrylamide-base polymers, and PAMs obtained by copolymerization of an acrylamide-base monomer and an acrylic acid-base monomer.

a. Partially-Hydrolyzed PAM

An acrylamide-base polymer usable in partial hydrolysis includes, for example, a homopolymer obtained by polymerizing acrylamide-base monomers alone (such as acrylamide; alkylacrylamide such as methacrylamide; and N-alkyl substituted (or N,N-dialkyl substituted) acrylamide such as N-methylacrylamide, N,N-dimethylacrylamide, N-ethylacrylamide, N,N-diethylacrylamide, and N-isoproprylamide); and a copolymer obtained by using two or more acrylamide-base monomers.

In addition, the acrylamide-base polymer can be a polymer obtained by copolymerizing an acrylamide-base monomer and another unsaturated monomer copolymerizable with the acrylamide-base monomer, wherein the amount of the unsaturated monomer is such that no adverse effect is exhibited. For example, the unsaturated monomer includes a hydrocarbon-base monomer such as ethylene, α-olefine, isobutylene, butadiene, isoprene, and styrene; (meth)acrylic acid ester such as methyl(meth)acrylate, and ocutyl(meth) acrylate; a polar monomer such as vinyl ether, vinyl chloride, acrylonitrile, and methyl(meth)acrylate.

As a partial-hydrolysis method, known methods such as alkaline hydrolysis can be employed.

The low-molecular anionic PAM used in the surface-treatment agent of the present invention may have partially been subjected to N-methylol treatment, thereby increasing stability. Also, anionization can be achieved in the form of a sulfomethylated compound of N-methylol PAM.

In the present invention, as for acrylamide-base polymers, a poly(meth)acrylamide is preferably used from an economic point of view or for other reasons, and further, polyacrylamide itself is most preferably used.

In anionic PAM obtained by partial hydrolysis, the partial-hydrolysis ratio, i.e., the ratio of anionic constituent units to the total constituent units of the low-molecular anionic PAM, is an important profile required for coating material used for a gate-roll coater. The partial-hydrolysis ratio is preferably 15% or lower (but not zero). If anionic PAM having a partial-hydrolysis ratio higher than 15% is applied by a gate-roll coater, releasing-property of the coated product sufferes, and thus neppari problems are likely to occur. On the other hand, if the partial-hydrolysis ratio is zero, a safety issue is realized in connection to the residual of acrylamide monomers. That is, although PAM itself is known as a safe compound, the monomer of PAM, acrylamide, is reported as a hazardous compound. Thus, it is important to eliminate as much the residual of acrylamide monomers as reasonable in production of PAM. Acrylamide monomers can be easily eliminated using alkali, and thus, alkaline hydrolysis employed in a partial-hydrolysis method, for example, is suitable. For the above point of view, the partial-hydrolysis ratio in the surface-treatment agent of the present invention should be more than zero %. As described later, the intended effects of the present invention can effectively be resulted from a partial-hydrolysis ratio of 1%. Even if the ratio is 1% or less, i.e., slight anionic character, the PAM can be used. In applying low-molecular anionic PAM using a gate-roll coater, as a tendency, the higher the partial-hydrolysis ratio, i.e., the higher the anionic character, the worse the releasing-property of the coated product becomes. Accordingly, in view of releasing-property, low partial-hydrolysis ratios are preferred, and a ratio of 5% or less is further preferred. However, considering productivity, molecular weight, safety in connection to the residual of acrylamide monomers, and the like, on the whole, an appropriate partial-hydrolysis ratio can be selected case-by-case in the range of 15% or less.

In conclusion, as for the surface-treatment agent of the present invention, acrylamide which has a weight average molecular weight of 10,000–150,000 and 15% or less of which is hydrolyzed, is one of preferred compounds. Further, acrylamide which has a weight average molecular weight of 30,000–80,000 and 15% or less of which is hydrolyzed, is more preferred, and acrylamide which has a weight average molecular weight of 30,000–80,000 and 5% or less of which is hydrolyzed, is more preferred, is most preferred.

The low-molecular anionic PAM used in the present invention can be produced by a modified partial hydrolysis, i.e., conducting polymerization reaction of acrylamide-base monomers in the presence of an alkali. In this method, polymerization reaction and partial-hydrolysis reaction occur simultaneously. In any event, the above-mentioned range of the partial-hydrolysis ratio is preferred.

b. Copolymerized PAM

An acrylamide-base monomer usable in a copolymerization method includes the aforesaid monomers. An acrylic acid-base monomer usable in the method includes acrylic acid, methacrylic acid, itaconic acid, crotonic acid, and fumaric acid, and alkaline metal salt, ammonium salt, and amine salt of the foregoing.

The low-molecular anionic PAM designed for the present invention can be produced by copolymerizing one or more acrylamide-base monomers and one or more acrylic acid-base monomers, using a conventional method. The copolymerization can fall within the block copolymerization category or the random copolymerization category. The low-molecular anionic PAM can also be a copolymer obtained by copolymerizing an acrylamide-base monomer and an acrylic acid-base monomer as well as another unsaturated monomer copolymerizable with the acrylamide-base monomer, wherein the amount of the unsaturated monomer is such that no adverse effect is exhibited.

In a copolymerization method in the present invention, as an acrylamide-base monomer, (meth)acrylamide is preferred, and as an acrylic acid-base monomer, acrylic acid, sodium salt thereof, potassium salt thereof, ammonium salt thereof, and amine salt thereof are preferred. Further, a combination of acrylamide and sodium acrylic acid or potassium acrylic acid is more preferred.

As with the low-molecular anionic PAM obtained by partial hydrolysis, the anionic-constituent-unit ratio for the low-molecular anionic PAM obtained by copolymerization, which corresponds to the aforesaid partial-hydrolysis ratio, i.e., the ratio of anionic constituent units to the total constituent units of the low-molecular anionic PAM, is an important profile required for coating material used for a gate-roll coater. The anionic-constituent-unit ratio may also be defined as the ratio of acrylic acid-base monomers to the total monomers. The anionic-constituent-unit ratio is preferably higher than 0% and no higher than 15% (zero % is not included). If low-molecular anionic PAM having an anionic-constituent-unit ratio higher than 15% is applied by a gate-roll coater, adhesiveness of the coated product increases, indicating that the PAM is not suitable as a surface-treatment agent. In general, the higher the anionic character, the worse the releasing-property of the coated product tends to become. Thus, in view of releasing-property, low anionic-constituent-unit ratios are preferred, and a ratio of 5% or less is further preferred. However, considering productivity, molecular weight of the polymers, and the like, on the whole, an appropriate partial-hydrolysis ratio can be selected case-by-case in the range of 15% or less.

In conclusion, as for the surface-treatment agent of the present invention, a copolymer obtained by copolymerizing 85 mole %–100 mole % of acrylamide with 0 mole %–15 mole % of a sodium salt or potassium salt of acrylic acid, which copolymer has a weight average molecular weight of 10,000–150,000, is one of the preferred compounds. Further, in the above, a copolymer which has a weight average molecular weight of 30,000–80,000, is more preferred, and a copolymer obtained by copolymerizing 95 mole %–100 mole % of acrylamide with 0 mole %–5 mole % of a sodium salt or potassium salt of acrylic acid, which copolymer has a weight average molecular weight of 30,000–80,000, is most preferred.

Other Components of Surface-Treatment Agent

The surface-treatment agents of the present invention basically comprise simply one type of the aforesaid anionic PAM, thereby exhibiting additional advantages, i.e., suppression of bubbling of coating material during coating operation by a gate-roll coater, and good applicability to a gate-roll.

The surface-treatment agents of the present invention can also comprise two or more types of low-molecular anionic PAM, as disclosed in Japanese Patent Laid-open Nos. 3-199489 and 5-163697. However, Japanese Patent Laid-open Nos. 3- 199489 and 5-163697 disclose high-molecular PAMs, and when high-molecular PAMs having a weight average molecular weight beyond the particular range, i.e., 10,000–150,000, are used, the high-molecular PAMs cause adverse effects on releasing-property of coated paper. Thus, plural numbers of PAM must have a weight average molecular weight in the above range.

In principle, the surface-treatment agents of the present invention can be substantially composed of low-molecular anionic PAM. The use of a surface treatment agent of low-molecular anionic PAM allows for good releasing-property when used in amounts of a coating in the range described later. However, for the sake of further improvement on releasing-property, a small amount of releasing components can be added in an amount such that adverse effects are not exhibited, e.g., as far as bubbling of coating material during coating operation by a gate-roll coater does not interfere with coating operation. Releasing components include the aforesaid adhesion-prevention agents disclosed in Japanese Patent Laid-open Nos. 6-57688 (1994) and 6-192995 (1994), and monoalkenyl succinate disclosed in Japanese Patent Laid-open No. 63-58960 (1988). The addition of the releasing components is preferably from 5% or less by weight based on the weight of the low-molecular anionic PAM.

In principle, it is not necessary to use components such as binders, other than the low-molecular anionic PAM, in combination with the surface-treatment agents of the present invention. However, in amounts such that no adverse effects occur, e.g., as far as releasing-property suffers, a small amount of such components can be added. Other components such as binders include, for example, starch-based material such as starch, modified starch (ammonium persulfate (APS) modified starch, enzymatically modified starch, etc.), α-starch, oxidized starch, starch derivatives (esterified starch such as acetylated starch, phosphoric esterified starch, etc.; etherified starch such as methylated starch, hydroxyethylated starch, etc.; and crosslinked starch, etc.), and grafted starch; cellulose-base material such as methylcellulose, ethylcellulose, and carboxymethylcellulose; latex such as styrene-butadiene copolymer, styrene-acrylonitrile copolymer, and styrene-butadiene-acrylic ester copolymers; PVAs such as completely saponified PVA, partially saponified PVA, amide-modified PVA, carboxy-modified PVA, and sulfonate-modified PVA; a homopolymer of nonionic PAM, and a homopolymer of acrylamide; and various resins such as silicone resin, petroleum resin, terpene resin, ketone resin, and coumarone resin. Since starch-based material and PVAs have a tendency towards increasing neppari strength (adhesion strength) when coated on paper, special attention should be paid to the amount employed in combination.

The surface-treatment agent of the present invention may include additives such as preservatives, anti-foaming agents, UV-preventing agents, fluorescent brighteners, viscosity stabilizers, and discoloration-preventing agents, and fillers as far as they do not materially affect the present invention.

Base Paper/Newsprint Base Paper

Although base paper of the present invention is not necessarily restricted to that for newsprint paper, the effects of the present invention are clearly observed in base paper for newsprint paper. Thus, the use of the present invention for newsprint paper is illustrated hereinafter.

Base paper for newsprint paper employed in the present invention is base paper manufactured using mechanical pulp (MP) such as grand pulp (GP), thermo-mechanical pulp (TMP) and semichemical mechanical pulp, and chemical pulp (CP) represented by kraft pulp (KP), and de-inked pulp (DIP) obtained by de-inking used paper containing the above- mentioned pulp, and recycling pulp obtained by disaggragating loss paper generated from a paper manufacturing process, etc. alone or in the form of a mixture thereof in any ratio. The effects of the present invention are exerted especially on base paper manufactured so as to have a basis weight lower than 46 g/m$^2$. For base paper with a basis weight not lower than 46 g/m$^2$, the surface strength appears to be satisfactorily sufficient due to high content of pulp fibers. Further, it may not be necessary for base paper having a basis weight not lower than 46 g/m$^2$ to use abundant fillers or pigments in order to maintain opacity or prevent ink from penetrating through paper. It may also be unnecessary to increase the contents of filler or pigments to compensate for low surface strength. Thus, the use of the surface-treatment agent is effective on base paper having a basis weight lower than 46 g/m$^2$.

The composition ratio of DIP in base paper employed in the present invention may be in any range (0–100%), and preferably in a range of 30–70% owing to the recent trend towards increasing the content of DIP.

In the present invention, suitable base paper for newsprint paper is base paper containing aluminum sulfate, i.e., so-called acid newsprint base paper. When base paper contains aluminum sulfate, anionic active groups contained in the low-molecular anionic PAM functioning as a surface-treatment agent are likely to be attracted to aluminum ions contained in the aluminum sulfate present in the vicinity of the surface of the base paper, thereby allowing for the low-molecular anionic PAM to stay in the vicinity of the surface of the base paper, i.e., efficiently improving surface strength of the base paper. The above ionic interaction between aluminum sulfate and low-molecular anionic PAM cannot be expected in pH-neutral base paper.

The base paper for newsprint paper in the present invention may contain, as necessary, filler for paper-making such as white carbon, clay, silica, talc, titanium oxide, synthetic resins (vinyl chloride resins, polystyrene resins, urea-formalin resins, melamine resins, styrene-butadiene copolymer resins, etc.); paper strength reinforcing agents such as PAM-base polymers, PVA (polyvinyl alcohol)-base polymers, cationized starch, urea-formalin resins, and melamine-formalin resins; freeness- or yield-improving agents such as salts of acrylamide-aminomethylacrylamide copolymers, cationized starch, polyethyleneimine, polyethylene oxide, and acrylamide-sodium acrylate copolymers; sizing agents such as reinforced rosin sizing agents (in the form of solution obtained by adding maleic acid anhydride or fumaric acid anhydride to rosin to give partially maleic or fumaric rosin, and completely saponifating the rosin with alkali to give the solution), emulsion-base sizing agents (in the form of aqueous dispersion obtained by dispersing partially maleic or fumaric rosin in water using rosin soap or various surface-activating agents as an emulsifier), synthetic sizing agents (based on petroleum resins obtained by copolymerizing $C_3$–$C_{10}$ distillates derived from naphtha distillate), and reactive sizing agents such as alkylketene dimers (AKD) and alkenyl succinic anhydride (ASA); adjuvants such as water-resisting agents, UV-preventing agents, and discoloration-preventing agents. The base paper needs to have physical properties enabling printing by an off-set printing press, and it is sufficient for base paper if the base paper possesses physical properties such as tensile strength, tear strength, elongation, etc.

Preparation of Coated Printing Paper

The paper of the present invention, especially paper for newsprint paper, can be produced by externally adding a surface-treatment agent comprising low-molecular anionic PAM to one side or both sides of base paper by using a coating transcription-type coater such as a gate-roll coater.

The coating weight of the surface-treatment agent in the present invention needs to be such that the contents of PAM components in the surface-treatment agent to be applied is preferably 0.01 g/m$^2$ or more measured as solid portion weight. In principle, the surface-treatment agent of the present invention can simply be composed of PAM components. In this regard, considering cases in which other components are incorporated, the coating weight of the surface-treatment agent is expressed by the coating weight of PAM components measured as solid portion weight, unless specified otherwise. The coating weight is further preferably in the range of from 0.01 to 0.2 g/m$^2$ measured as the solid weight of PAM components. If the coating weight of PAM components is less than 0.01 g/m$^2$, the PAM components are not likely to contribute to improvement of surface strength due to insufficient amounts. On the other hand, even if the coating weight is more than 0.2 g/m$^2$, the effects on surface strength reach a plateau, which is not economical.

As a coater, coating-transcription-type coaters such as a gate-roll coater, a blade rod metalling coater, and the like can be used; most preferably, a gate-roll coater is used. In a coating-transcription-type coater, a predetermined amount of coating material is transcribed from an applicator roll to base paper at a given thickness. Thus, the use of a coater of this type is very effective in applying the coating material to the surface of base paper. In the newsprint paper of the present invention, as described above, since the coating weight of PAM components is low, the use of a transcription coater is effective. It is also clear that an on-machine system is preferred from an economic point of view. In the newsprint paper of the present invention, double-sided paper, i.e., both sides of paper are coated, using a gate-roll coater, is most preferable.

Namely, the paper such as newsprint paper of the present invention can be produced by externally adding a surface-treatment agent comprising low-molecular anionic PAM to both sides of the aforesaid base paper such as base paper for newsprint paper, using a gate-roll coater.

By applying with a gate-roll coater a surface-treatment agent comprising low-molecular anionic PAM having a weight average molecular weight ranging from 10,000 to 150,000 (preferably 3,000 to 80,000), to the surface of base paper having a basis weight less than 46 g/m$^2$, in an amount ranging from 0.01 g/m$^2$ to 0.2 g/m$^2$, lightweight newsprint paper having good surface strength and releasing-property can be obtained. Although the technological reasons for the above effects have not yet been clearly explicated, the following reasons are assumed:

Heretofore, material for a gate-roll coater was mainly designed for improving surface strength, and thus, high-molecular anionic PAM exhibiting highly improved surface strength and low penetration was used. However, in view of releasing-property, it appears that the fact that high-molecular anionic PAM tends to remain on the surface adversely affects releasing-property. In contrast, it appears that the low-molecular anionic PAM used in the present invention exhibits high penetration into base paper and effectively contributes to releasing-property. Further, in the present invention, since coating operation is conducted using a gate-roll coater, penetration of the low-molecular anionic PAM into base paper remains minimal, although the low-molecular anionic PAM itself has a tendency to high penetration. As a result, the PAM can remain near the surface of base paper, and surface strength does not suffer if the weight average molecular weight is 10,000 or higher.

In addition, in the low-molecular anionic PAM of the present invention, the ratio of anionic constituent units to the total constituent units (i.e., the anionization ratio) is, although it is not as influential as molecular weight, one of the factors affecting releasing-property. When anionic character of low-molecular anionic PAM is strong, the PAM tends to remain on the surface of base paper due to the strong anionic character facilitating settlement of the PAM towards aluminum atoms in aluminum sulfate. When anionic character of low-molecular anionic PAM is weak, the PAM tends to weaken settlement of the PAM and increase penetration into the inside of the base paper, thereby improving releasing-property. Accordingly, the anionization ratio is preferably more than zero % but no more than 15%, more preferably lower than 5%.

In any event, it will be advantageous to releasing-property that the low-molecular anionic PAM penetrates the paper to a certain degree, as compared with the low-molecular anionic PAM completely remaining on the surface. This may be one of reasons why the particular anionic PAM of the present invention is superior in terms of releasing-property. That is, in the present invention, when acid base paper containing aluminum sulfate is used, the use of low-molecular anionic PAM as a surface-treatment agent for external addition in combination with gate-roll coating operation are very effective in both surface strength and releasing-property.

EXAMPLES

Hereinafter, referring to preparation examples, examples and comparative examples using newsprint paper, the present invention will be described in detail, but it is not limited to these. Parts in the description denote weight parts.

<Making Newsprint Base Paper>

35 parts of DIP (de-inked pulp), 30 parts of TMP (thermomechanical pulp), 20 parts of GP (grand pulp) and 15 parts of KP (kraft pulp) were mixed and macerated to regulate the freeness at 200. This mixed pulp was manufactured into an unsized and uncalendared newsprint base paper at the rate of 1,000 m/min by using a Bervet former paper machine. This base paper was 43 g/m$^2$ in weight. The thus-obtained base paper contained aluminum sulfate.

<Preparation of Surface-Treatment Agent>

Preparation Examples 1–6

According to conventional methods, acrylamide was subjected to polymerization in an aqueous solution under various conditions in the presence of ammonium persulfate and sodium hydrogensulfite to produce homopolymer-based PAMs in the form of an aqueous solution (PAM-1–6).

Preparation Examples 7 and 8

According to conventional methods, acrylamide (95 equivalents) and methacrylamide (5 equivalent) were subjected to polymerization in an aqueous solution under various conditions in the presence of ammonium persulfate and sodium hydrogensulfite to produce copolymers of acrylamide and methacrylamide in the form of an aqueous solution. The thus-obtained solutions were subjected to alkaline hydrolysis to obtain anionic PAMs, each having a partial-hydrolysis ratio of higher than 0% but no higher than 15% in the form of an aqueous solution (PAM-7–8).

Preparation Example 9

According to conventional methods, acrylamide (95 equivalents) and sodium acrylate (5 equivalents) were subjected to polymerization in an aqueous solution at a reaction temperature of 60° C.–80° C. in the presence of ammonium persulfate and sodium hydrogensulfite to produce anionic PAM in the form of an aqueous solution (PAM-9).

Preparation Example 10

According to conventional methods, acrylamide (90 equivalents) and sodium acrylate (10 equivalents) were subjected to polymerization in an aqueous solution at a reaction temperature of 60° C.–80° C. in the presence of ammonium persulfate and sodium hydrogensulfite to produce anionic PAM in the form of an aqueous solution (PAM-10).

Preparation Example 11

According to conventional methods, acrylamide (97 equivalents) and potassium acrylate (3 equivalents) were subjected to polymerization in an aqueous solution at a reaction temperature of 60° C.–80° C. in the presence of ammonium persulfate and sodium hydrogensulfite to produce anionic PAM in the form of an aqueous solution (PAM-11).

Preparation Example 12

According to conventional methods, acrylamide (99 equivalents) and aluminum itaconate (1 equivalent) were subjected to polymerization in an aqueous solution at a reaction temperature of 60° C.–80° C. in the presence of ammonium persulfate and sodium hydrogensulfite to produce anionic PAM in the form of an aqueous solution (PAM-12).

Preparation Examples 13–16

According to conventional methods, acrylamide was subjected to polymerization in an aqueous solution under various conditions in the presence of ammonium persulfate and sodium hydrogensulfite to produce polyacrylamide in the form of an aqueous solution. The thus-obtained solutions were subjected to alkaline hydrolysis to obtain anionic PAMs, each having a given partial-hydrolysis ratio in the form of an aqueous solution (PAM-13–16).

Preparation Example 17

According to conventional methods, acrylamide (60 equivalents) and sodium acrylate (40 equivalents) were subjected to polymerization in an aqueous solution at a reaction temperature of 60° C.–80° C. in the presence of ammonium persulfate and sodium hydrogensulfite to produce anionic PAM in the form of an aqueous solution (PAM-17).

Preparation Example 18

According to conventional methods, acrylamide (80 equivalents) and sodium acrylate (10 equivalents) were subjected to polymerization in an aqueous solution at a reaction temperature of 60° C.–80° C. in the presence of ammonium persulfate and sodium hydrogensulfite to produce anionic PAM in the form of an aqueous solution (PAM-18).

The average polymerization degree (measured by GPC) and the anionization ratio (the ratio of anionic constituent units to the total constituent units) of the resulting various anionic PAMs (PAM-1–18) are listed "MW" (molecular weight) and "ANION %", respectively, in Table 1.

TABLE 1

| Pre. Ex. No. | PAM | MW | ANION % |
|---|---|---|---|
| 1 | PAM-1 | 12,000 | 5 |
| 2 | PAM-2 | 65,000 | 1 |
| 3 | PAM-3 | 65,000 | 5 |
| 4 | PAM-4 | 65,000 | 10 |
| 5 | PAM-5 | 65,000 | 15 |
| 6 | PAM-6 | 145,000 | 3 |
| 7 | PAM-7 | 98,000 | 2 |
| 8 | PAM-8 | 98,000 | 12 |
| 9 | PAM-9 | 35,000 | 5 |
| 10 | PAM-10 | 80,000 | 10 |
| 11 | PAM-11 | 124,000 | 3 |
| 12 | PAM-12 | 148,000 | 2 |
| 13 | PAM-13 | 5,000 | 10 |
| 14 | PAM-14 | 65,000 | 20 |
| 15 | PAM-15 | 470,000 | 5 |
| 16 | PAM-16 | 2410,000 | 1 |
| 17 | PAM-17 | 133,000 | 40 |
| 18 | PAM-18 | 320,000 | 10 |

<Preparing Newsprint Paper>

Examples 1–17

The aqueous solutions of anionic PAMs (PAM-1–12, 14, and 17) having a weight average molecular weight ranging from 10,000 to 150,000 were diluted to given concentrations, and the resulting diluted solutions were applied as a coating solution to one side of the aforesaid newsprint base paper having a basis weight of 43 g/m$^2$, in an amount of 0.01 g/m$^2$–0.20 g/m$^2$, by using a gate-roll coater. After the application, the resulting newsprint base paper was super-calendared. In the above, bubbling of the coating during gate-roll coating operation was negligible.

Comparative Examples 1–4

The aqueous solutions of anionic PAMs (PAM-13, 15, 16, and 18) having a weight average molecular weight falling outside the range of from 10,000 to 150,000 were diluted to given concentrations, and the resulting diluted solutions were applied to one side of the aforesaid newsprint base paper as a coating solution by using a gate-roll coater. After the application, the resulting newsprint base paper was super-calendared to obtain the comparative newsprint paper.

Comparative Examples 5 and 6

The aqueous solutions of anionic PAMs (PAM-12) were diluted to given concentrations, and the resulting diluted solutions were applied to one side of the aforesaid newsprint base paper as a coating solution, in an amount outside of the range of 0.01 g/m$^2$–0.20 g/m$^2$, by using a gate-roll coater. After the application, the resulting newsprint paper was super-calendared to obtain the comparative newsprint paper.

On the newsprint papers of Examples 1–17 and Comparative Examples 1–6, the amount of coating PAM, the surface strength, and neppari strength were measured.

Measuring Amounts of Coating PAMs

Each newsprint paper was cut, placed in a decomposition tube, and allowed to stand for several minutes after adding concentrated sulfuric acid to the decomposition tube. A hydrogen peroxide aqueous solution and a decomposing agent were added to the tube to conduct heat decomposition. The resulting reaction solution was diluted to a given concentration and introduced to a Kjeldahl analyzer to measure the nitrogen content. From the nitrogen content, the solid weight of coating PAM was calculated.

Measuring Surface Strength

Two types of measuring methods, i.e., measuring printing strength by a Pruefbau printing tester and measuring the FRT (Fiber rising test) were performed and papers with favorable scores in both measured values were judged as "being excellent in surface strength."

Surface Strength A (printing strength by a Pruefbau printing tester):

A deep red ink (Dainippon Ink & Chemical Inc.) was put on a rubber roller of a Pruefbau printing tester and applied to a newsprint paper (printed area: 4×20 cm) at a printing pressure of 15 N/m$^2$ and printing speed of 6.0 m/sec. The number of rising fibers upon detachment of a rubber roller and newsprint paper during coating operation was counted using a microscope.

A smaller value indicates greater surface strength. With the present invention, papers on which the number of rising fibers is 20 or less are judged as "being excellent in surface strength."

Surface Strength B (FRT):

A 300 mm×35 mm sheet was cut from a newsprint paper in the direction of a machine and the number of fuzzy fibers in a definite area (1 m$^2$) longer than 0.1 mm was determined by using a surface analyzer FIBER 1000 (Fibro system AB).

A smaller value indicates a greater surface strength. With a newsprint paper according to the present invention, papers in which the number of fuzzy fibers per 1 m$^2$ is 30 or less are judged as "being strong in surface strength."

Measuring Neppari Strength (Peeling Strength)

After cutting two 4×6 cm sheets from a newsprint paper and soaking the coated surface in water at a temperature of 20° C. for 5 sec, both sheets were closely adhered on mutual coated surfaces. Newsprint base papers were overlaid on both outer surfaces, passed between the rollers under a pressure of 50 kg/cm$^2$ and humidified at 25° C. and 60% RH for 24 hours. After a 3×6 cm test piece was prepared, measurement was performed at 30 mm/min tensile speed by a tensile tester.

A higher measured value signifies greater difficulty in peeling (namely, a stronger adhesion). With a newsprint paper according to the present invention, papers whose neppari strength is 26.0 g/3 cm or less were classified as those of "good separability", and further, papers whose neppari strength is 20.0 g/3 cm or less were classified as those of "excellent separability."

The results of the examples and comparative examples are shown in Table 2. In Table 2, with respect to neppari strength, "*0" means no adhesiveness and no adhered sample prepared according to the aforesaid measuring method.

TABLE 2

| No. | PAM | Coating ($g/m^2$) | Surface Strength A (piece) | Surface Strength B (piece) | Neppari (g/3cm) |
|---|---|---|---|---|---|
| Ex. 1 | PAM-1 | 0.17 | 25 | 24 | *0 |
| Ex. 2 | PAM-2 | 0.15 | 9 | 18 | 4.0 |
| Ex. 3 | PAM-2 | 0.04 | 23 | 22 | *0 |
| Ex. 4 | PAM-3 | 0.16 | 9 | 18 | 4.3 |
| Ex. 5 | PAM-4 | 0.10 | 13 | 19 | 4.4 |
| Ex. 6 | PAM-5 | 0.17 | 7 | 17 | 5.5 |
| Ex. 7 | PAM-6 | 0.12 | 12 | 18 | 10.7 |
| Ex. 8 | PAM-7 | 0.11 | 13 | 18 | 7.9 |
| Ex. 9 | PAM-8 | 0.13 | 12 | 17 | 8.3 |
| Ex. 10 | PAM-9 | 0.19 | 23 | 20 | *0 |
| Ex. 11 | PAM-10 | 0.09 | 13 | 19 | 6.7 |
| Ex. 12 | PAM-10 | 0.02 | 24 | 21 | 1.0 |
| Ex. 13 | PAM-11 | 0.06 | 18 | 19 | 6.9 |
| Ex. 14 | PAM-12 | 0.18 | 5 | 16 | 14.6 |
| Ex. 15 | PAM-12 | 0.98 | 19 | 19 | 9.8 |
| Ex. 16 | PAM-14 | 0.15 | 10 | 19 | 24.2 |
| Ex. 17 | PAM-17 | 0.13 | 12 | 18 | 25.1 |
| Com. 1 | PAM-13 | 0.25 | 55 | 35 | 1.5 |
| Com. 2 | PAM-15 | 0.07 | 13 | 19 | 34.7 |
| Com. 3 | PAM-16 | 0.07 | 12 | 17 | 85.9 |
| Com. 4 | PAM-18 | 0.12 | 13 | 19 | 33.6 |
| Com. 5 | PAM-12 | 0.003 | 90 | 48 | 4.0 |
| Com. 6 | PAM-12 | 0.24 | 5 | 16 | 40.5 |

Surface Strength A: excellent: 50 or less
Surface Strength B: strong: 30 or less
Neppari Strength: good: 26 or less Comparative Example 7

An aqueous solution of oxidized starch (trade name: SK-20, available from Nihon Corn Starch Ltd.) was prepared (solid portion weight ratio was 4%). This aqueous solution was applied as a coating solution to one side of the aforesaid newsprint base paper by using a gate-roll coater. After the coating operation, the coated base paper was super-calendared to obtain a newsprint paper of the comparative example. The results of the evaluation tests on this newsprint paper were as follows:

Coating weight: 0.17 $g/m^2$

Surface strength A: 60

Surface strength B: 55

Neppari strength: 20.5 g/3 cm

Comparative Example 8

By adding a random copolymer of ethylene oxide and propylene oxide to an aqueous solution of PVA (trade name: K-17, available from Denki Kagaku Kogyo K.K.) at a ratio of 5 parts of copolymer to 100 parts of PVA, a coating solution was prepared. The obtained coating solution was applied to one side of the aforesaid newsprint base paper by using a gate-roll coater. After the coating operation, the coated newsprint base paper was super-calendared to obtain a newsprint paper of the comparative example. The results of the evaluation tests on this newsprint paper were as follows:

Coating weight: 0.20 $g/m^2$

Surface strength A: 39

Surface strength B: 40

Neppari strength: 27.8 g/3 cm

Comparative Example 9

By adding 5 parts by weight of ammonium perfluorooctanate (disclosed in Japanese Patent Laid-open No. 6-57688 (1994)) to 95 parts by weight of the aqueous solution of oxidized starch used in Comparative Example 7, a coating solution was obtained. The obtained coating solution was applied to one side of the aforesaid newsprint base paper by using a gate-roll coater. However, bubbling of the coating solution was intensive and interfered with the coating operation to the extent that it could not be conducted.

Comparative Example 10

By adding 5 parts by weight of octenyl succinic anhydride (disclosed in Japanese Patent Laid-open No. 6-192995 (1994)) to 95 parts by weight of the aqueous solution of oxidized starch used in Comparative Example 7, a coating solution was obtained. The obtained coating solution was applied to one side of the aforesaid newsprint base paper by using a gate-roll coater. However, bubbling of the coating solution was intensive and interfered with the coating operation to the extent that it could not be conducted.

Example 18

By mixing 30 parts by weight of the anionic PAM of PAM-10 and 90 parts by weight of the anionic PAM of PAM-3, a coating solution was obtained. The obtained coating solution was applied to one side of the aforesaid newsprint base paper by using a gate-roll coater. After the coating operation, the coated newsprint base paper was super-calendared to obtain a newsprint paper. The results of the evaluation tests on this newsprint paper were as follows:

Coating weight: 0.12 $g/m^2$

Surface strength A: 12

Surface strength B: 17

Neppari strength: 9.4 g/3 cm

In the above, bubbling of coating materials during gate-roll coating was slightly detectable, but it did not interfere with the coating operation.

Comparative Example 11

By mixing 70 parts by weight of the anionic PAM of PAM-3 (weight average molecular weight: 100,000 or higher) and 30 parts by weight of the anionic PAM of PAM-15 (weight average molecular weight: 400,000 or higher), a coating solution was obtained. The obtained coating solution was applied to one side of the aforesaid newsprint base paper by using a gate-roll coater. After the coating operation, the coated newsprint base paper was super-calendared to obtain a newsprint paper. The results of the evaluation tests on this newsprint paper were as follows:

Coating weight: 0.10 $g/m^2$

Surface strength A: 12

Surface strength B: 18

Neppari strength: 38.4 g/3 cm

Comparative Example 12

By mixing 97 parts by weight of the anionic PAM of PAM-2 (weight average molecular weight: 50,000–1,000,000) and 3 parts by weight of the anionic PAM of PAM-16 (weight average molecular weight: 2,000,000–20,000,000), a coating solution was obtained. The obtained coating solution was applied to one side of the aforesaid newsprint base paper by using a gate-roll coater. After the coating operation, the coated newsprint base paper was super-calendared to obtain a newsprint paper. The results of the evaluation tests on this newsprint paper were as follows:

Coating weight: 0.12 $g/m^2$

Surface strength A: 11

Surface strength B: 19

Neppari strength: 39.8 g/3 cm

As represented by this comparative example, although the weight average molecular weight falls within the range of the present invention, when large-molecular anionic PAM is used, even if the amount is very small, neppari strength increases. Therefore, the objective of the present invention cannot be achieved.

Comparative Example 13

By adding 4 parts by weight of an aqueous solution of 1% glyoxal to 10 parts by weight of an aqueous solution of 10% anionic PAM (weight average molecular weight: 600,000; anionization ratio: 10%), followed by reaction of the mixture at a temperature of 70° C., an anionic PAM-glyoxal reaction product was obtained as a coating solution. The obtained coating solution was applied to one side of the aforesaid newsprint base paper by using a gate-roll coater. After the coating operation, the coated newsprint base paper was super-calendared to obtain a newsprint paper. The results of the evaluation tests on this newsprint paper were as follows:

Coating weight: 0.14 g/m$^2$

Surface strength A: 13

Surface strength B: 19

Neppari strength: 30.3 g/3 cm

Comparative Example 14

After adding sodium hydroxide equivalent to 5 mole % to polyacrylamide (weight average molecular weight: 470,000, PAM-15 without partial hydrolysis), partial hydrolysis was conducted, followed by the Mannish reaction using formaldehyde equivalent to 40 mole % and dimethyl amine equivalent to 45 mole % to obtain a Mannish reaction product of polyacrylamide. The resulting reaction product and the anionic PAM of PAM-15 were mixed at a ratio of 1:1 and diluted to a given concentration to obtain a coating solution. The obtained coating solution was applied to one side of the aforesaid newsprint base paper by using a gate-roll coater. However, bubbling of the coating solution was intensive and interfered with the coating operation to the extent that coating operation could not be continued for long. After brief coating operation, the coated newsprint base paper was super-calendared to obtain a newsprint paper of the comparative example. The results of the evaluation tests on this newsprint paper were as follows:

Coating weight: 0.18 g/m$^2$

Surface strength A: 13

Surface strength B: 18

Neppari strength: 45.6 g/3 cm

Comparative Example 15

By reacting the anionic PAM of PAM-18 with formaldehyde and dimethyl amine, an anionic-PAM Mannish reaction product containing 10% of a Mannish base was obtained. The resulting reaction product was diluted to a given concentration to obtain a coating solution. The obtained coating solution was applied to one side of the aforesaid newsprint base paper by using a gate-roll coater. After the coating operation, the coated newsprint base paper was super-calendared to obtain a newsprint paper of the comparative example. The results of the evaluation tests on this newsprint paper were as follows:

Coating weight: 0.11 g/m$^2$

Surface strength A: 19

Surface strength B: 23

Neppari strength: 40.1 g/3 cm

In will be understood by those of skill in the art that numerous various and modifications can be made without depating from the spirit of the present invention. Therefore, it should be clearly understood that the forms of the present invention are illustrative only and are not intended to limit the scope of the present invention.

We claim:

1. A printing paper comprising:

a base paper; and a coating layer formed on said base paper by using a gate-roll coating-transcription system, for improving surface strength of the coated paper and releasing-property when two sheets of the coated paper are stacked, said coating layer comprising an anionic polyacrylamide in an amount of from 0.01 g/m$^2$ to 0.2 g/m$^2$ per side of said base paper, said anionic polyacrylamide having a weight average molecular weight ranging from 10,000 to 150,000.

2. A printing paper according to claim 1, wherein said coating layer consists essentially of said anionic polyacrylamide.

3. A printing paper according to claim 1, wherein more than zero % but no more than 15% of said anionic polyacrylamide is hydrolyzed.

4. A printing paper according to claim 1, wherein the weight average molecular weight of said anionic polyacrylamide is 30,000–80,000.

5. A printing paper according to claim 3, wherein more than zero % but no more than 5% of said anionic polyacrylamide is hydrolyzed.

6. A printing paper according to claim 1, wherein said anionic polyacrylamide is a copolymer obtained by copolymerizing 85 mole %–100 mole % of acrylamide with 0 mole %–15 mole % of sodium or potassium acrylate.

7. A printing paper according to claim 6, wherein said anionic polyacrylamide is a copolymer obtained by copolymerizing 95 mole %–100 mole % of acrylamide with 0 mole %–5 mole % of sodium or potassium acrylate.

8. A printing paper according to claim 1, wherein said base paper has a basis weight less than 46 g/m$^2$.

9. A printing paper according to claim 1, wherein said base paper contains aluminum sulfate.

10. A printing paper according to claim 8, wherein said base paper is newsprint base paper.

11. A printing paper according to claim 1, wherein both sides of said base paper have said coating layers.

12. A method for producing a printing paper, comprising:

applying to one side or both sides of a base paper by using a gate-roll coating-transcription system, a coating solution comprising an anionic polyacrylamide to form a coating layer on said base paper for improving surface strength of the coated paper and releasing-property when two sheets of the coated paper are stacked, said anionic polyacrylamide having a weight average molecular weight ranging from 10,000 to 150,000, said anionic polyacrylamide being applied in the range of from 0.01 g/m$^2$ to 0.2 g/m$^2$ per side of said base paper.

13. A method according to claim 12, wherein said coating solution consists essentially of said anionic polyacrylamide as solid weight portion.

14. A method according to claim 12, wherein more than zero % but no more than 15% of said anionic polyacrylamide is hydrolyzed.

15. A method according to claim 12, wherein the weight average molecular weight of said anionic polyacrylamide is 30,000–80,000.

16. A method according to claim 12, wherein said anionic polyacrylamide is a copolymer obtained by copolymerizing 85 mole %–100 mole % of acrylamide with 0 mole %–15 mole % of sodium or potassium acrylate.

17. A method according to claim 12, wherein said base paper contains aluminum sulfate.

18. A method according to claim 12, further comprising super-calendaring the coated paper.

* * * * *